US005884788A

United States Patent [19]

Wilde

[11] Patent Number: 5,884,788

[45] Date of Patent: Mar. 23, 1999

[54] TAMPER-INDICATING CLOSURE

[76] Inventor: Sheldon L. Wilde, 5418 Noblet Ct., Indianapolis, Ind. 46234-2031

[21] Appl. No.: 992,145

[22] Filed: Dec. 17, 1997

[51] Int. Cl.[6] ..... B65D 41/34

[52] U.S. Cl. ..... 215/230; 215/252; 215/253; 215/351; 215/349

[58] Field of Search ..... 215/230, 250, 215/252, 253, 331, 341, 342, 346, 349, 350, 351

[56] References Cited

U.S. PATENT DOCUMENTS

| | | | |
|---|---|---|---|
| 2,054,032 | 9/1936 | Conner et al. | 215/252 |
| 2,560,793 | 7/1951 | Greene . | |
| 2,939,597 | 6/1960 | Greene . | |
| 4,378,894 | 4/1983 | Willis et. al. | 215/252 |
| 4,446,979 | 5/1984 | Gaunch et al. . | |
| 4,473,163 | 9/1984 | Geiger . | |
| 4,505,399 | 3/1985 | Weiner . | |
| 4,531,649 | 7/1985 | Shull . | |
| 4,564,117 | 1/1986 | Herbert . | |
| 4,721,219 | 1/1988 | Dullabaun et al. . | |
| 4,801,028 | 1/1989 | Puresevic et al. . | |

FOREIGN PATENT DOCUMENTS

WO 94/29186 8/1994 WIPO .

*Primary Examiner*—Stephen K. Cronin
*Assistant Examiner*—Nathan Newhouse
*Attorney, Agent, or Firm*—Rockey, Milnamow & Katz, Ltd.

[57] ABSTRACT

A tamper-indicating closure for a container includes a cap with removable panels of a top wall of the cap. Each removable panel is connected to a tab on the inside of the cap. The top wall includes inner and outer cams on an inside surface and the tabs underlie the cams. A liner disc is applied inside the cap for sealing against the container. A plurality of spaced-apart ratchet teeth are arranged in one or two circular patterns on the liner disc and sized and located such that the circular pattern of teeth meshes with the two cams. The tabs have a toothed transverse cross-section which allow the tabs to ride over the ratchet teeth in a screwing-on direction to the cap, but the tabs are engaged by the ratchet teeth in a screwing-off direction of rotation of the cap. Since the liner disc and ratchet teeth are stationary with respect to the container, unscrewing of the cap causes the ratchet teeth to separate the panels from the moving cap.

26 Claims, 5 Drawing Sheets

TAMPER-INDICATING CLOSURE

TECHNICAL FIELD

The present invention relates generally to a closure for a container, the closure having tamper-indicating elements, and particularly to a tamper-evident closure having indicating panels in the end wall of an outer closure cap which are visibly displaced when the closure is removed from its respective container. Tamper-indication is provided by relative rotation of the outer closure cap with respect to an inner disc which sealingly engages the container.

BACKGROUND OF THE INVENTION

Conventional bottle caps or closures for carbonated beverages have included cork and plastic liners and metal fluted caps which are crimped around the radius lip of a glass bottle. Recent bottle closures have included a plastic or metal cap with a frangible ring which interlocks with the bottle neck to be held in axially fixed position while an upper cap portion is unscrewed. U.S. Pat. No. 5,564,582 describes such a frangible ring tamper-evident closures.

A closure including an inner disc having applied thereon a container-engaging liner element and an overlying outer screw cap are known. In this type of closure, the liner element is secured to the lower face of the disc for engagement with a top of an associated container. The outer plastic cap includes screw threads which are advanced onto respective formations of the container which presses the disc and liner into sealing engagement with the container.

It is also known, in general, to provide one or more breakable or frangible elements arranged in a top wall of the outer closure cap. Such structures are disclosed, for example, in published PCT Application WO 94/29186.

The need exists for a closure that can be inexpensively manufactured, applied to both pressurized and partially evacuated containers, and can provide an effective seal by closure rotation, and tamper evidence by a subsequent counter-rotation. The closure needs to maintain its effective seal even with the imposition and release of heavy top loading, such as that experienced in storage and shipment.

The need exists for a closure which has a high degree of reliability against liner failure and displacement, tamper evidence accuracy, and seal integrity after repeated reclosures. The need exists for a tamper evident closure having clear indication of prior closure removal. The need exists for a tamperevident closure which is difficult to remove without triggering indication of prior removal.

SUMMARY OF THE INVENTION

The present invention pertains to a co-called "top tamper evident" closure, which provides tamper-indication without the need for a lower portion of the closure to be mechanically interlocked with the associated container. The two-piece construction includes an inner disc having a high-friction sealing surface (either inside or outside of the bottle finish) to provide a non-rotating seal, low torque application, and removal, and closure back-off prevention, as well as temper-evidence.

The invention includes a closure having a shell or cap having a disc-shaped end wall and a depending skirt, the skirt having threads on an inside surface thereof for engaging cooperating formations on a container, such as a bottle neck. A liner disc is interfit within the shell against the disc-shape end wall. The end wall includes tamper-indicating, removable panels which are defined by weakened perimeters through the top wall. The weakened perimeters can be formed by gaps or cuts entirely through or partially through the end wall.

Each panel is connected by an elongate tab within the shell and which is extended over and preferably onto two cams or tracks formed on an inside surface of the end wall. The liner disc includes a plurality of ratchet teeth arranged to press the tab between the two cams when the liner disc is installed into the shell and the shell is screwed down tightly onto a container. The tabs themselves preferably have triangular-shaped cross-sections which define tab teeth.

In operation, during an installation of the closure to a container, the liner disc presses the ratchet teeth to deform the tab between the two cams, but during tightening of the closure to the container, the shape of the tab teeth allows the ratchet teeth of the liner disc to slide relatively easily across the tab without displacement of the tab (and its attached panel) with respect to the end wall. The cap includes a stop surface positioned adjacent the cams for engagement with the tab as the closure is applied to the associated container. The stop surface assures that the tabs move across the teeth of the liner disc during tightening of the cap as the cap moves relative to the disc. This prevents undesired displacement of the tabs during closure application, and avoids premature fracture of the tamper-indicating removable panels to which the tabs are connected.

When the shell is unscrewed from the container in a reverse direction, the shape of the tab teeth causes the ratchet teeth of the liner disc to engage the tab and forcibly move the tab with respect to the end wall, which displaces and removes the removable panels accordingly. The shape of the liner disc beneath the removable panels provides for a tab reservoir such that the removed panel with tab attached does not fall into the container.

The liner disc can be a contrasting color to the shell such that the removable panels allow the liner disc color to be seen through the holes vacated by the removable panels to further alert the consumer that the closure has been previously loosened.

By providing a top wall-removable-panel tamper-evident closure, the shell can be vented during removal through the removable panels as the removable panels are separated. This optionally allows for the elimination or minimizing of vent grooves in the thread regions of the shell skirt. It is further contemplated that vent grooves can be employed in combination with the removable panels to optimize venting during closure removal, while avoiding passage of moisture through the top wall after removal of the panels. Thus, a continuous thread can be used which increases the overall strength of the thread engagement with the container. This increase in strength therefore allows for shell and skirt portions to have correspondingly thinner walls which results in a savings in materials of construction.

Other features and advantages of the present invention will become readily apparent from the following detailed description, the accompanying drawings, and the appended claims.

DETAILED DESCRIPTION OF THE PREFERRED EMBODIMENTS

Figure 1:
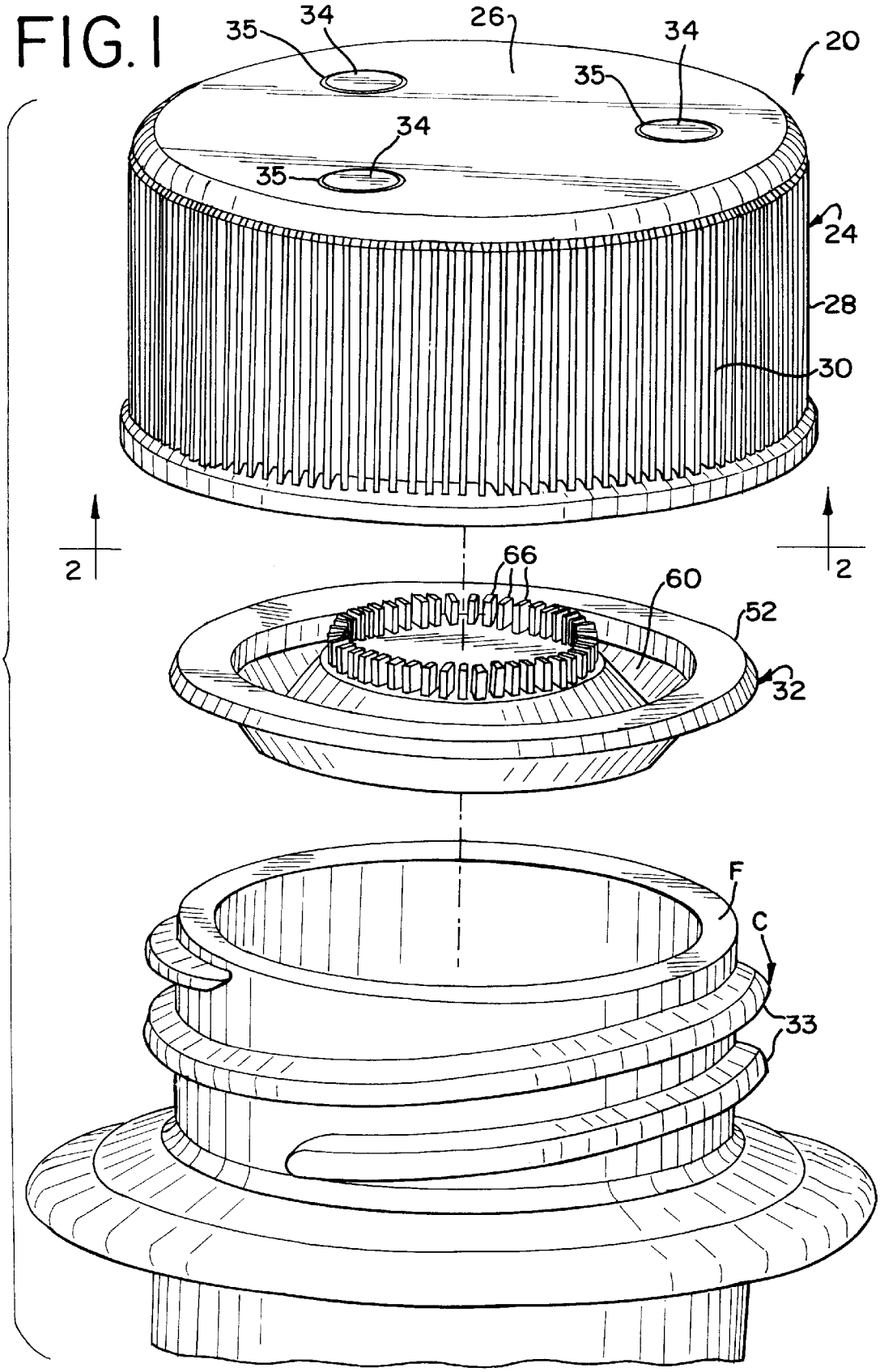
FIG. 1 is an exploded perspective view of a closure assembly of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

For convenience of description, terms of relative orientation or position such as "top", "bottom", "below", "above" are used and should be understood to be referring to the arbitrary orientation of the invention as depicted in FIG. 1. The invention however, encompasses all orientations.

FIG. 1 illustrates a closure assembly 20 of the invention. The closure assembly includes an outer shell or a cap 24 having a disc-shaped end wall or top wall 26 and a depending annular skirt 28. The skirt 28 includes knurling-like ribs 30 which assist in gripping the shell by a user to exert a twisting force on the shell to install or remove the closure from a container.

Shown on the end wall 26 are removable panels 34, such as in this case three circular removable panels, which constitute frangible tamper-evidence components in accordance with the present invention.

A liner disc 32 (described below) interfits into the cap 24 and the cap is screwed onto a container C having a sealing finish F. The container C includes threads 33 which engage coacting threads of the cap 24 described below.

Figure 2:
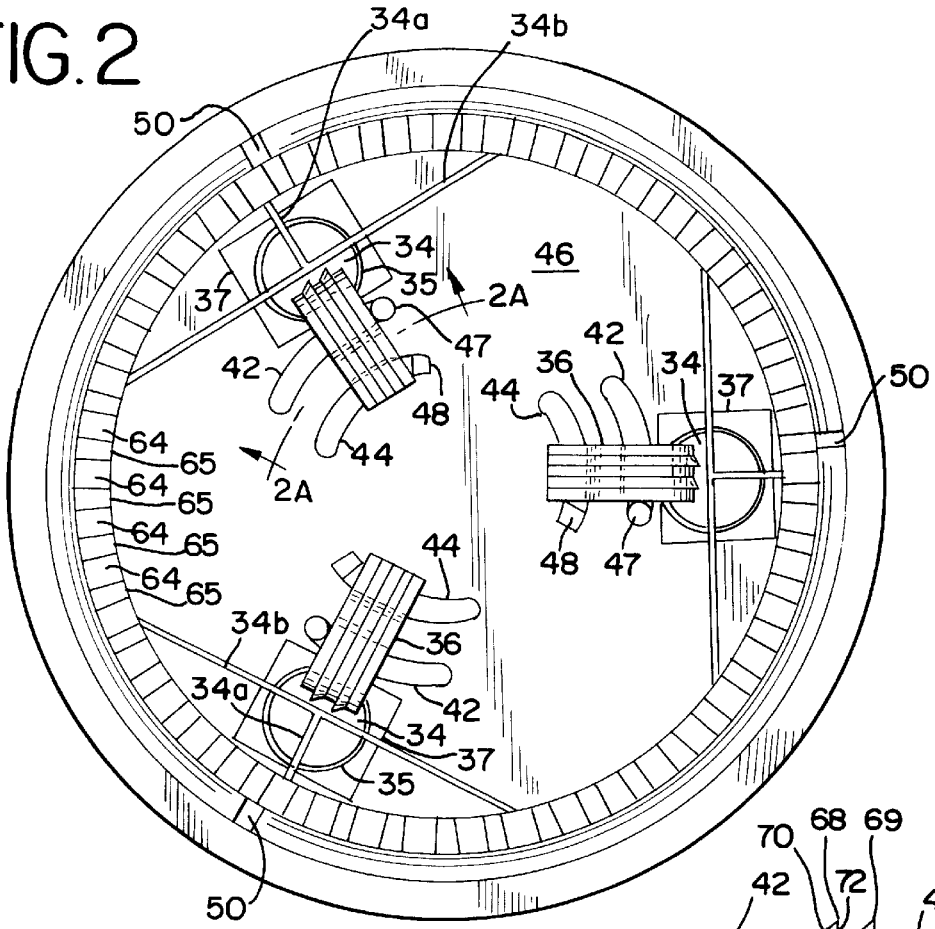
FIG. 2 is a bottom view of a cap of the closure assembly taken generally along plane 2—2 of FIG. 1.

As illustrated in FIG. 2, the removable panels 34 include weakened peripheral portions or perimeters 35 formed such as by molding, scoring, or cutting a slot(s), a gap(s), or perforations partially through or completely through the end wall 26, either continuously or intermittently around the panels 34. The panels are held in place to the end wall 26 by frangible "residuals" or bridges 34*a*, 34*b* which can be molded into the end wall 26. The frangible bridges can be molded so that complete cutting (i.e., scoring) through the end wall 26 defines panels 24, with the unscored bridges (i.e., the residual portion) providing the desired frangible connection of each panel to the end wall. Alternatively, a cutting or scoring device having an interrupted cutting edge can be used so that uncut portions of the end wall provide the desired frangible bridges. Formation of frangible portions comprising thin membranes for holding each panel is also contemplated.

Surrounding the perimeters 35 are squares 37 which define the boundaries of areas of reduced thickness, including the thickness of the panels 34 but not the residuals 34*a*, 34*b*. Thus, when the weakened perimeter 35 is formed or cut, the perimeter 35 can extend completely through a thickness of the end wall 26 but only partially through a thickness of the residuals 34*a*, 34*b*. This allows the panels 34 to be removed easily and precisely, upon breaking of the residuals. In a current embodiment, the end wall has a full thickness of 0.016 inches, the area within the square 37 has a reduced thickness of 0.008 inches. The residuals have a thickness of 0.008 inches throughout the square 35 but have a reduced thickness of 0.003 inches where the residuals cross the perimeter 35.

The removable panels 34 are shown having extending tabs 36 each of which overlie parallel arcuate wall formations or "cams" 42, 44 formed extending perpendicularly from an inside surface 46 of the end wall 26. As will be further described, each cam 42, 44 includes a downwardly extending stop 47, 48 respectively at one end thereof, with an additional stop 48' preferably positioned therebetween. Stops 47, 48, and 48' together provide the cap 24 with a stop surface extending perpendicularly from the inside surface of the cap. Each stop surface is engageable with the respective tab 36 during application of the closure to a container.

The cap 24 includes threads 49 for engagement with the container threads 33 for holding the cap to the container and exerting sufficient axial force therebetween to seal between the liner disc 32 and the container finish F. Gaps 50 can be provided axially through the threads 49 to allow venting of gas from the container during opening.

Figure 3:
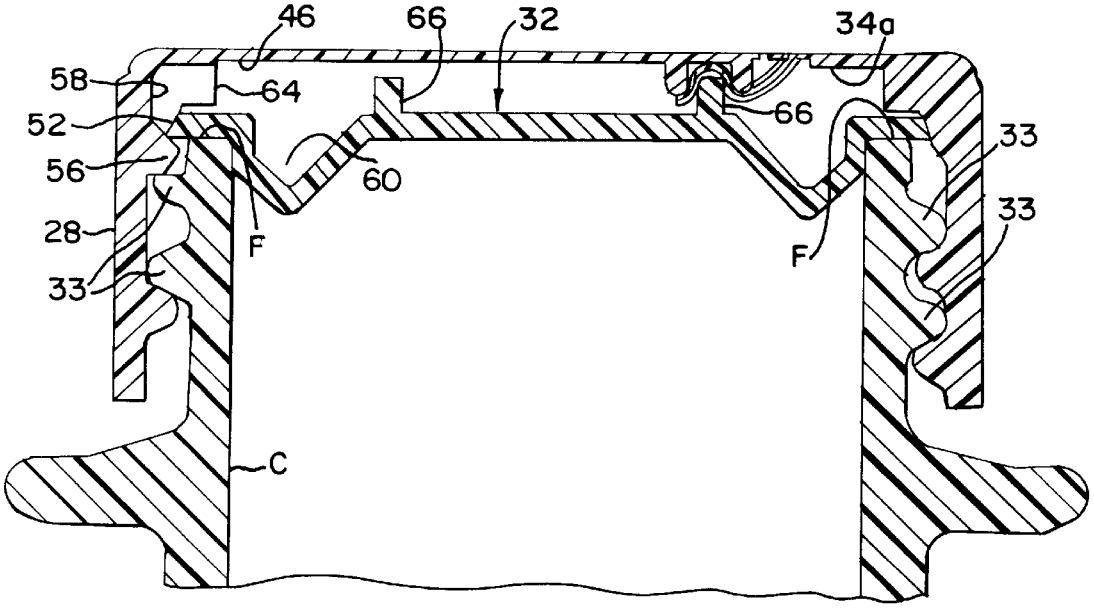
FIG. 3 is a sectional view of the closure assembly of FIG. 1 in an assembled condition.

As illustrated in FIGS. 1 and 3, the liner disc 32 is placed within the shell 24 and retained around its outer circumference 52 by a plurality of disc retainers 56 formed on the inside surface 58 of the skirt 28. An annular well 60 is formed on the liner disc 32 for receiving the panels 34 once separated from the end wall.

The liner disc is held between the disc retainers 56 and disc support ribs 64 formed integrally with the shell 24. The disc support ribs 64 are arranged closely spaced around an inside circumference of the cap 24. In a current embodiment, forty-five support ribs are provided spaced at 8 degrees apart. A space between adjacent support ribs 64 define vent slots 65. Thus, gas within the container can be released, prior to complete disengagement of the respective thread formations, in a controlled fashion during unscrewing of the cap 24 by exhausting gas past the liner disc 32, through the vent slots 65, and through apertures vacated by the panels 34. It may thus be possible to eliminate or minimize the gaps so through the threads 49. By so eliminating these gaps the threads can be made stronger by being continuous, and a thickness reduction in the skirt wall 28, and materials savings, may be possible.

Returning to FIG. 1, the liner disc 32 includes a plurality of bar-shaped, ratchet teeth 66 arranged in a circle and extending upward on a surface of the liner disc 32 facing the end wall 26 of the shell 24. The ratchet teeth 66 are arranged in a selected circumference such that the ratchet teeth 66 align between each pair of the first and second cams 42, 44. Ratchet teeth 66 can be generally bar-shaped, and are preferably inwardly tapered at the upper ends thereof into a generally triangular or rounded configuration. In a current embodiment, each tooth 66 has converging surfaces arranged at a 60° angle.

On an end of the cams are the cam stops 47, 48 respectively, with stop 48' positioned therebetween. When the shell is screwed down tight onto a container C, the container finish F, presses the liner disc 32 such that the ratchet teeth 66 press and bend each of the tabs 36 onto and between the respective two cams 42, 44. The stops 47, 48, and 48' collectively provide a stop surface which engages the respective tab during closure application, thus precluding undesired displacement of each tab. The stop surface provided by stops 47, 48, and 48' is generally U-shaped, this maximizing engagement with the generally U-shaped portion of respective tabs positioned between the pair of cams 42, 44. The provision of stop 48' positioned between the cams is particularly desirable since it most directly acts in opposition to the ratchet teeth 66, and helps to prevent excessive deformation of the tab.

Figure 2A:
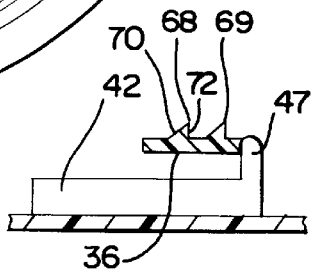
FIG. 2A is a fragmentary sectional view taken generally along plane 2—2 of FIG. 2.

As shown in FIG. 2A, each tab 36 has a sawtooth cross-section with two upwardly extending tab teeth 68, 69. Each of the teeth can be configured to include a sloped surface 70 backed by a vertical surface 72.

When the cap is turned in a screwing-on direction for closure application, typically clockwise onto the container C, during a few final tightening degrees of rotation, the liner disc is held stationary by friction against the container finish F. The stops 47, 48, and 48' hold the tabs 36 substantially stationary with respect to the end wall 26 while each of the sloped surfaces 70 allow the cap to turn freely with respect to the liner disc by the tab teeth 68, 69 riding over the ratchet teeth 66.

When the cap is thereafter turned in a screwing-off direction for closure removal, typically counterclockwise off the container C, the vertical surfaces 72 of the tab teeth are engaged by the ratchet teeth 66 and are held substantially stationary with the liner disc by the teeth, as the remainder of the cap rotates. The cams 42, 44 assist in holding the tabs 36 in position as the frictional grip of the ratchet teeth 66 in opposition to the rotating cap 24 cause forced displacement of the removable panels 34 from the end wall 26 by breaking the bridges 34*a*, 34*b* and separation of the weakened perimeters 35.

Although three coacting assemblies are shown in FIG. 2, each including a removable panel 34, a tab 36 and a pair of cams 42, 44 as shown and described, any number of assemblies, one or greater is encompassed by the invention. Although circular panels are shown, other shapes are contemplated by the invention, including panels which have number or letter shapes, trademark or logo shapes, or decorative shapes.

The above-described embodiment, wherein the tabs 36 extend generally radially inwardly of the respective panels 34, can be particularly desirable for some applications. When the closure is used on containers having carbonated contents, pressure within the container can act to outwardly deform or "dome" the liner disc 32. This outward deformation can desirably act to increase the interference between the disc teeth 66 and the associated tabs during closure removal. However, since such deformation does not take place until the closure is fully applied to the container, such interference is avoided during closure application, minimizing deformation of the teeth and tabs during application. Additionally, this orientation of the tabs maximizes the mechanical advantage created by the disc liner frictionally engaging the container, with the torque created providing the desired force for fracture of panels 34. Even though a somewhat greater degree of relative rotation between the disc and outer shell is required to effect panel fracture, a liner material exhibiting a relatively lower coefficient of friction with the container can be employed, if desired.

Figure 4:
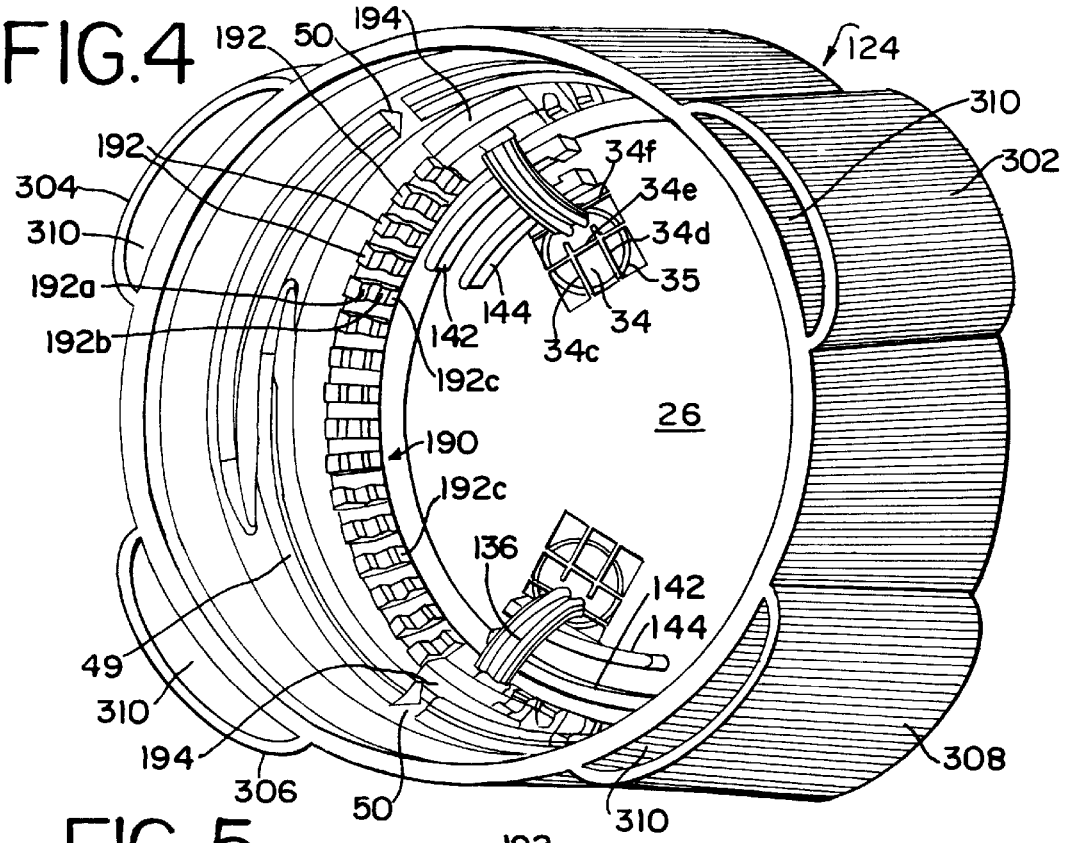
FIG. 4 is a perspective bottom view of an alternative cap of an alternative closure assembly.
Figure 5:
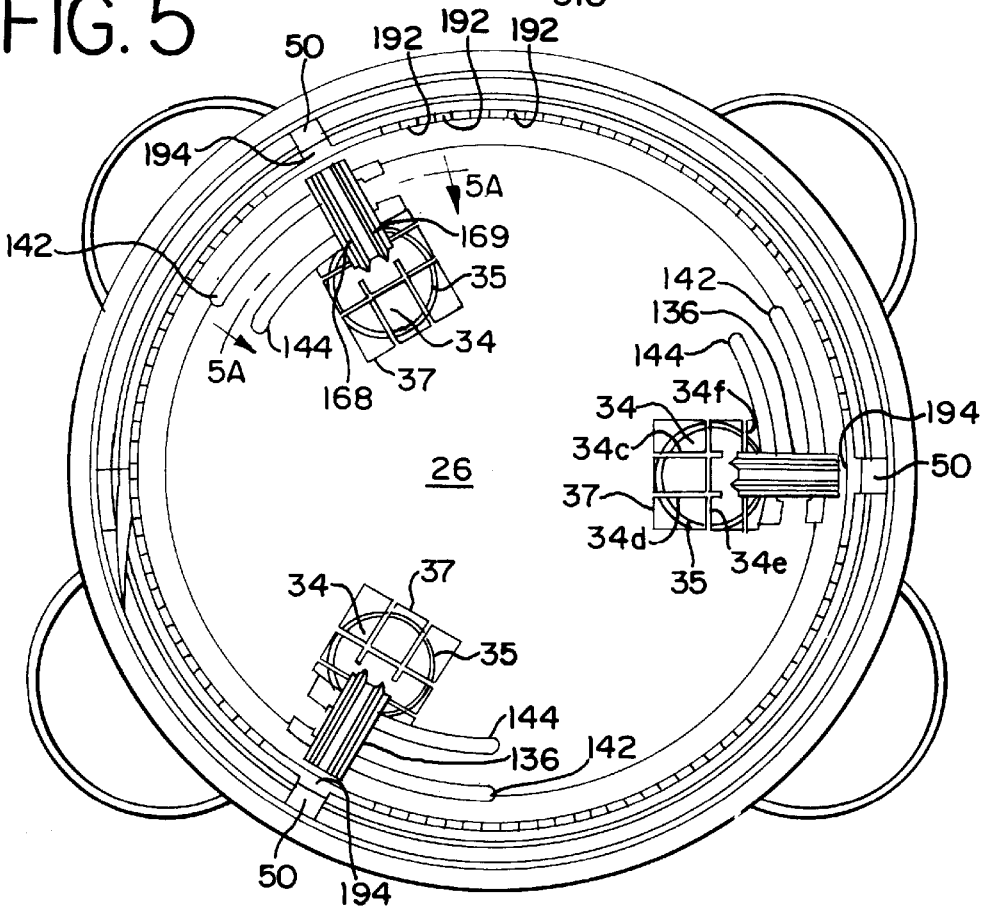
FIG. 5 is a bottom view of the alternative cap of FIG. 4.
Figure 6:
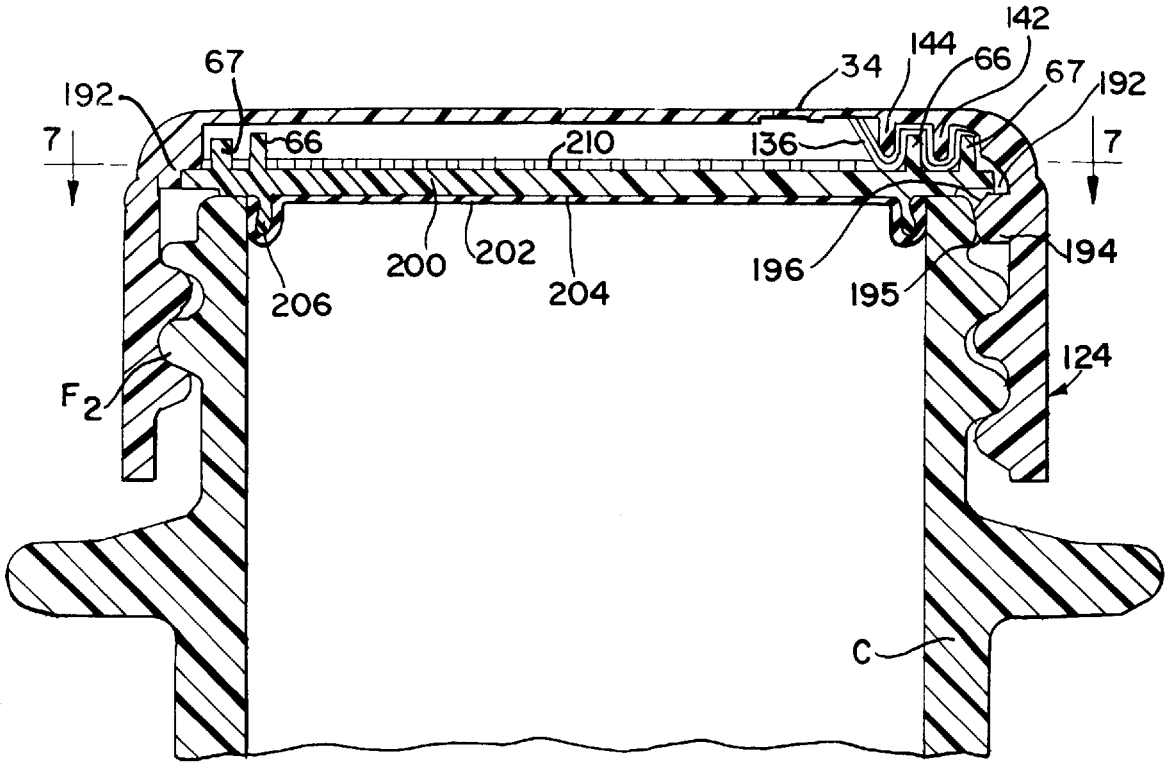
FIG. 6 is a sectional view of the alternative embodiment closure assembly corresponding to FIG. 4.

FIGS. 4 through 6 illustrate an alternate embodiment cap 124. This embodiment shares some common features with the previously described cap and like components are indicated with like numerals. In distinction from the previous embodiment which included frangible panels each having a tab extending radially inwardly, the panels of this embodiment each include a tab extending radially outwardly. The removable panels 34 are located on the end wall 26 radially inward of cams 142, 144, and tabs 136 extend from the panels 34 radially outwardly. The panels 34 are defined by weakened perimeters 35, and connected to the remainder of the end wall 26 by residuals or bridges 34*c*, 34*d*, 34*e*, 34*f*, as shown.

Figure 5A:
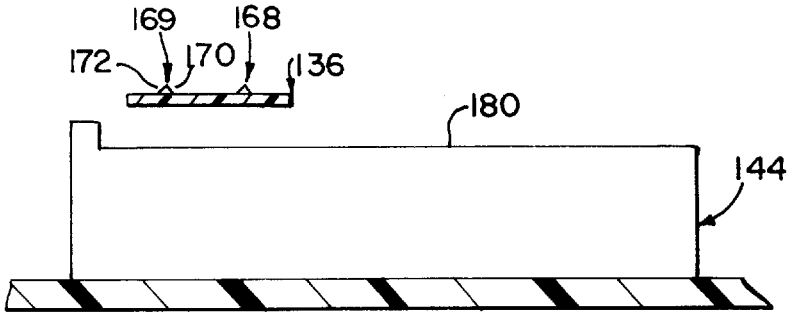
FIG. 5A is a fragmentary sectional view taken generally along plane 5A—5A of FIG. 5.

As illustrated in FIGS. 5 and 5A, the tabs 136 include two tab teeth 168, 169, each having opposing inclined surfaces 170, 172. The cam 144 includes a tab stop 176. This tab stop acts during screw-tightening of the cap 124 onto a container, as described above with respect to the stop 48. The tab 136 is shown elevated from the cam 144 in FIG. 5A by its resiliency but will be forcibly brought into contact with an upper surface 180 of the cam 144 when the cap 124 is brought into contact with a liner disc.

FIG. 4 illustrates the cap 124 includes a skirt 128 having an annular supporting structure 190 which includes spaced apart support ribs 192 all around an inner circumference of the skirt 128. The support ribs 192 have an L-shaped seating surface having a vertical surface 192*a* for guiding the liner disc radially and a radial surface 192*b* for supporting the liner disc against axial sealing force from the container C.

A front wall 192*c* of each rib 192 faces radially inwardly. Vent slots 193 are located between ribs 192 to allow gas to escape through the cap and through the apertures vacated by the panels 35. However, since the flow area of the apertures vacated by the panels is respectively large, absent a corrective measure, too great a venting flow during unscrewing the cap would be directed upwardly, resulting in unwanted moisture above the cap, and possibly on a user's hand. To balance the distribution of gas venting between upward venting through the area vacated by the panels 35, and downward venting through the gaps 50 through the threads 49, the front walls 192*c* can be made continuous around the inner circumference of the cap, i.e., bridging between each rib 192, forming an annular wall (not shown) covering most of the area of the vent slots 193. A limited number of notches (not shown) or places where the front walls are not continuous between ribs 192, can be provided as vent orifices to control the flow resistance of upward venting.

Disc retainers 194 are spaced apart around the inner circumference of the skirt 128. The disc retainers 194 include a first radially inclined surface 195 facing toward an open end of the cap 124, and a second radially inclined surface 196 facing toward the end wall 26. The disc retainers 194 extend radially to an extent to allow a liner disc to be inserted into the cap, forcing the retainers apart resiliently, past the disc retainers 194 in an insertion direction, to be retained by the disc retainers inside the cap, close to the end wall 26.

FIG. 6 illustrates the cap 124 assembled onto a container C. A liner disc 200 has a liner 202 secured thereto across an outside surface 204 and over an annular lip 206. The liner 202 seals against an inside surface of the container C, in the nature of a so-called plug seal. A first, inner circle 207 of ratchet teeth 66 extend upwardly from a top surface 210 of the liner disc 200. The first circle 207 has a radius R1. A second circle 208 of ratchet teeth 67 surrounds the first circle 207. The second circle 208 has a radius R2 (FIG. 7) which differs from radius R1. Although not illustrated, it is contemplated that the second circle 208 of ratchet teeth can be formed as a continuous rib, preferably having a downwardly projecting V-shaped edge (in cross-section) to further enhance engagement and retention of tabs 136. The second circle of rachet teeth 67 is spaced radially from the first circle 207, either outwardly (as shown), or inwardly thereof if the tabs extend inwardly of the fracturable panels.

Some of the ratchet teeth 66, 67 of both circles 207, 208 press and bend each tab 136 between and over the cams 142, 144. The tabs 136 are bent in a serpentine shape by the meshing of the inner and outer circles 207, 208 of the ratchet teeth 66, 67 with the cams 142, 144. The cams 142, 144 also provide at least the one stop 176 (FIG. 5) for preventing differential rotation between the tabs 136 and the cams 142, 144, i.e., between the panels 34 and the cap 124. Like the previous embodiment, step 176 preferably defines a generally U-shaped stop surface for enhancing engagement with the respective tab 136. The tabs include the tab teeth 168, 169 with inclined surfaces 170, which allow the ratchet teeth 66, 67 to ride over the tabs 136 during tightening of the cap 124 to a container. During subsequent unscrewing, the tabs are restrained from differential movement from the stationary liner disc 200 by the ratchet teeth 66, 67 engaging the inclined surfaces 172, while the cap 124 is rotated, and the panels 34 are thus separated from the end wall 26 by breakage of the residuals 34*c*, 34*d*, 34*e*, and 34*f*.

Figure 7:
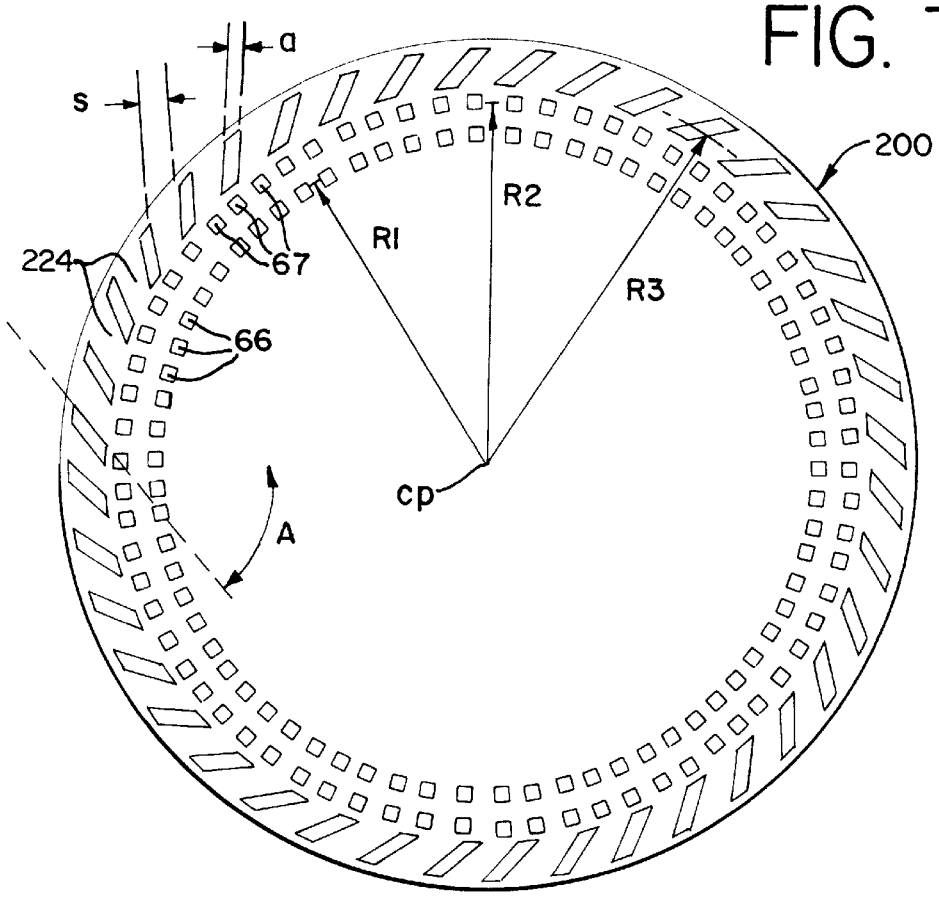
FIG. 7 is a sectional view taken generally along plane 7—7 of FIG. 6.

FIG. 7 illustrates the liner disc 200 in detail. The ratchet teeth 66, 67 are arranged around inner and outer circles 207, 208 evenly spaced. A plurality of parallelogram-shaped slots 220 are formed or cut through the liner disc 200 in an outer edge region thereof at a mean radius R3. The slots have a width "a", preferably a=0.012 inches. The slots are spaced at a spacing "s", preferably s=0.015 inches, forming approximately ninety spokes 224. The spokes and slots are angled at "A", preferably A=45 degrees from radial lines from a center point "cp". The spokes preferably are approximately 0.015 inches thick. The spokes provide sufficient strength for the liner disc 200 to be retained by the disc retainers 194 into the cap, but at the same time are sufficiently weak that the cap 124 cannot be radially squeezed sufficiently to obtain a firm radial grip on the liner disc (through the skirt of the cap). Thus, a person attempting to defeat the tamper indicating function of the closure could not force the liner disc to rotate with the cap 124 because the outer edge region of the liner disc would collapse radially before sufficient torque could be generated to overcome the friction between the liner disc and the container.

Figure 8:
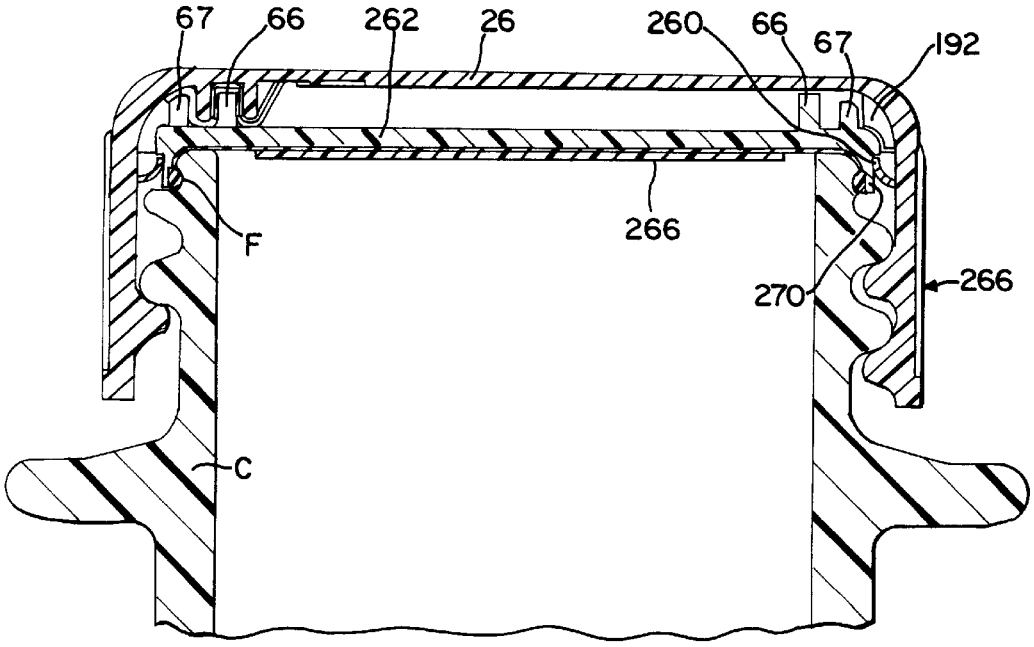
FIG. 8 is a sectional view of a further alternative embodiment closure assembly.

FIG. 8 describes an alternate embodiment which includes resilient disc retainers 260 which allow passage of a liner disc 262 into the cap 264. The disc retainers are in the form of circumferentially spaced apart flexible webs 265 which are inclined or curved toward the end wall 26 to allow forced flexing of the retainer to permit passage of the disc 262 past the retainers toward the end wall 26. The retainers are shaped to prevent the reverse direction movement, thus retaining the liner disc 262 near to the end wall 26. The retainers are preferably 0.010 inches thick, and 0.055 inches long. There are preferably 6 to 8 retainers, each accounting for 20 to 30 degrees of arc.

The liner disc 262 includes a liner 266 for sealing against a container C at a finish F. The liner disc 262 includes an annular flange 268 having spaced apart slots 270 (not shown) for integrating the liner 266 to the liner disc 262.

The caps illustrated in FIGS. 1, 4 and 8 can also be formed with a generally rectangular outer profile to provide an improved gripping shape for mechanical advantage in twisting off the cap. As illustrated in FIGS. 4 and 5 the outer profile can be enhanced for achieving mechanical advantage by adding molded curved loops 302, 304, 306, 308 at 90° points around the cap. The loops 302, 304, 306, 308 have a depth substantially equal to the cap skirt 128 (into the page of FIG. 5). The loops are partial-circular shaped having a smaller diameter than the cap, and having axes parallel to an axis of the cap. An open space 310 is formed between each of the loops and an outer surface of the skirt 128. The space is open at both top and bottom faces of the cap 124. An outer surface 312 of each loop is knurled for ease of gripping and twisting of the cap.

The liner discs 32, 200, 262 can be provided with an index notch to preposition the liner disc with respect to the cap.

Although the removable panels are shown as circular areas, it is advantageous that the removable panels could be in the shape of letters or other insignias such that upon their removal, the colored disc would show through the letter shapes removed from the cap. The letters could spell "open" or the product name such as "cola" or other messages.

It is also contemplated by the invention that the liner disc be a contrasting color to the cap such that removal of the panels 34 gives a readily apparent indication of the tamper-evident condition. The cap can also be transparent giving additional visual evidence of the condition and fractioning of the tamper evident condition.

Also, it is contemplated by the invention that the aperture vacated by a removable panel or panels could also function as a spout for dispensing liquid through the cap. A provision such as an aperture through the liner disc, would be made for dispensing through the cap.

Thus, a highly effective tamper-evident closure assembly is disclosed which is configured for economical use on containers having either carbonated or non-carbonated contents. Because the liner disc of the assembly ordinarily is not subjected to any significant rotation during closure application and removal, application torques are desirably low to facilitate high-speed bottling, and removal torques are desirably low to facilitate ease of use by consumers. Various types of liner configurations can be employed, including liners effecting a so-called top/side seal on the top, outside surface of the associated container, or a so-called plug-type seal on the generally inwardly facing surface of the container.

An additional feature of the subject design is the audible nature of the interengagement of the tabs of the outer closure cap with the ratchet teeth of the inner liner disc. Because the closure assembly need not be configured to mechanically interlock with the typical flange-like locking ring of a container finish (positioned beneath the container threads), significant material savings can be obtained. If desired, associated containers can be configured to coact with the closure assembly of the present invention, without the need to configure containers to include the typically required annular locking ring and thread formation.

While the illustrated embodiments of the present closure are each configured to include a cap having at least one stop surface for engagement with a respective tab during closure application, it is within the purview of the present invention to optionally provide one or more stop members on the liner disc. Such an arrangement can be employed to limit relative rotation of the outer cap and inner disc during closure application. By way of example, the disc could be provided with three stops or dogs, and the outer cap provided with one stop or dog, engageable with any one of the three stops on the disc. Relative rotation would thus be limited to no more than about 120°. Limitation of such relative rotation can desirably act to minimize deformation of the teeth and tabs (which interact to provide tamper-indication) during closure application, and can enhance sealing engagement of the inner liner disc with the associated container.

From the foregoing, it will observed that numerous modifications and variations can be effected without departing from the spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A tamper-evident closure for a container, said closure rotatably attached to said container, comprising:

a cap having a removable panel with a weakened perimeter;

an resiliently flexible elongated tab connected to said removable panel;

a stationary portion, arranged to be held substantially stationary relative to the container, said stationary portion having a member extending therefrom and pressing said elongated tab, and said tab and said member shaped to resist movement of said tab when said cap is unscrewed from the container to remove said removable panel from said cap.

2. The closure according to claim 1, wherein said member comprises a plurality of teeth arranged along a circular path on said stationary portion.

3. The closure according to claim 1 wherein said cap further comprises a cam extending downwardly toward said stationary portion and pressing said tab against said stationary portion adjacent said member, and a stop surface engageable with said tab when said closure is applied to said container.

4. The closure according to claim 1 wherein said cap comprises a pair of cams extending toward said stationary portion and arranged on opposite lateral sides of said member, said cams pressing said tab against said stationary portion and restraining said tab when said cap is unscrewed from the container.

5. The closure according to claim 4 wherein said cams are arranged around circular paths, and said member comprises a plurality of spaced-apart ratchet teeth arranged around a circular path, said cap including a generally U-shaped stop surface engageable with said tab.

6. The closure according to claim 5 wherein said tab comprises a toothed profile in cross-section allowing said tab to pass by said ratchet teeth in a screwing-on direction of said closure to a container but resisting relative movement between said tab and said ratchet teeth in a screwing-off rotational direction of said closure from the container.

7. The closure according to claim 1, wherein said stationary portion comprises a disc extending across said cap, said disc having a liner for sealing said closure to said container.

8. The closure according to claim 1, further comprising a second removable panel on said cap and a second tab extending from said second removable panel and held against a second member on said stationary portion, said second member and said second tab shaped to resist movement of said second tab when said cap is unscrewed from the container.

9. The closure according to claim 1, wherein said member comprising a plurality of teeth, said cap further comprises a pair of cams, spaced apart and extending downwardly toward said stationary portion on opposite sides of said teeth, said tab bent between said cams and said teeth.

10. The closure according to claim 1, wherein said cap comprises a cam extending downwardly toward said stationary portion, said member comprises a plurality of first teeth around a first circular path and a plurality of second teeth around a second circular path having a radius which differs from the radius of said first circular path, said cam located between said first and second circular paths to bend said elongate tab in serpentine fashion against said cam and at least one tooth of said first teeth and at least one tooth of said second teeth.

11. The closure according to claim 10 wherein said cap comprises a second cam concentric to said first cam and arranged on an arcuate path on an inside of said first circular path, said tab bent in serpentine fashion over said second cam, at least one of said first teeth, said first cam, and at least one of said second teeth.

12. The closure according to claim 1 wherein said cap includes a plurality of extending members applied on an outer surface of said cap for providing twisting leverage to a user.

13. The closure according to claim 12 wherein said extending members comprise loops having an axis parallel to an axis of said cap.

14. A tamper-evident closure for a container, the container having a threaded neck and said closure having internal threads for threading said closure onto said neck, comprising:

a cap for screwing onto the container neck having an end wall with a plurality of spaced apart removable panels, each panel defined by a weakened perimeter;

a plurality of tabs, each tab connected to one of said removable panels on an inside surface thereof;

a plurality of pairs of cams, a pair of said cams formed on said end wall adjacent each removable panel, each of said cams extending on an inside surface of said end wall, said pair of cams being located on inner and outer concentric circular paths, said tabs arranged extending across each respective pairs of cams; and a liner disc arranged within said cap to seal against the container neck when said cap is screwed onto the container neck, said liner disc including a plurality of first ratchet teeth extending toward said end wall of said cap and arranged on an intermediate circular path located between said inner and outer circular paths of said two cams, to interfit therebetween; and said tabs being pressed against at least one of said ratchet teeth by said cam pairs, and said tabs having a cross-section with extending tab teeth allowing said tabs to ride over said ratchet teeth in a screwing-on direction of said cap to said container, but resisting relative displacement between said tabs and said ratchet teeth in a screwing-off direction of said cap, said resisting sufficient to remove said removable panels from said end wall.

15. The closure according to claim 14 wherein said removable panels are arranged radially inwardly of said cams.

16. The closure according to claim 14 wherein said removable panels are arranged radially outwardly of said cams.

17. The closure according to claim 14 wherein said liner disc includes an annular rim having a plurality of spokes.

18. The closure according to claim 14 wherein said weakened perimeter is defined by a substantially continuous groove through said end wall and a plurality of bridges which cross said groove and connect said panels to a surrounding portion of said end wall.

19. The closure according to claim 14 wherein said cap includes a stop surface extending perpendicularly with respect to said end wall and located to prevent differential movement between said tab and said end wall during screwing on of said cap to the container neck.

20. The closure according to claim 14 wherein said liner further comprises a plurality of second teeth arranged around another circular path spaced from said intermediate circular path, said second teeth extending toward said end wall of said cap, said tabs bent in serpentine fashion over said pair of cams and at least one of each of said first and second teeth.

21. A tamper-evident closure for a container, comprising:

a cap having an end wall with a removable portion defined by a weakened perimeter and a skirt having threads;

a resiliently flexible tab portion extending from said removable portion;

a stationary portion held stationary to the container when the closure is screwed on and having a member for abutting said tab portion;

a ratchet arrangement applied between said tab portion and said stationary member to allow relative displacement therebetween in a screwing-on rotational direction and resistance to relative displacement in a screwing-off rotational direction to remove said removable portion from said end wall.

22. The closure according to claim 21 wherein said ratchet arrangement comprises at least one tab tooth applied on said tab portion having a first surface sloped downward and oblique to a tangent in said screwing-on rotational direction, and said stationary member comprises at least one ratchet tooth extending from said stationary portion to engage said tab tooth.

23. The closure according to claim 22 wherein said stationary member includes a plurality of ratchet teeth arranged spaced apart around a circle.

24. The closure according to claim 22 wherein said cap comprises a pair of cam portions extending from said cap and located to be on opposite sides of said ratchet tooth, said tab portion bent by said cam portions and said ratchet tooth to thread under said cam portions and over said ratchet tooth, and at least one of said cam portions include an end stop surface extending perpendicularly to said wall to restrain said tab portion from moving on said cam portions.

25. The closure according to claim 24 wherein said ratchet arrangement comprises a second ratchet tooth extending from said stationary portion at a position spaced radially from said first rachet tooth for engaging an end of said tab portion.

26. The closure according to claim 21, wherein said cap includes a stop surface engageable with said tab during application of said closure to said container.

* * * * *